US006389979B1

(12) United States Patent
Theurer et al.

(10) Patent No.: US 6,389,979 B1
(45) Date of Patent: May 21, 2002

(54) ASSEMBLY FOR TAMPING BALLAST

(75) Inventors: Josef Theurer, Vienna; Friedrich Peitl, Linz, both of (AT)

(73) Assignee: Franz Plasser Bahnbaumaschinen-Industriegesellschaft m.b.H., Vienna (AT)

( * ) Notice: Subject to any disclaimer, the term of this patent is extended or adjusted under 35 U.S.C. 154(b) by 19 days.

(21) Appl. No.: 09/611,832

(22) Filed: Jul. 7, 2000

(30) Foreign Application Priority Data

Jul. 23, 1999 (AU) ..... A 1282/99

(51) Int. Cl.[7] ..... F01B 27/06
(52) U.S. Cl. ..... 104/10; 104/12
(58) Field of Search ..... 104/10, 12, 2

(56) References Cited

U.S. PATENT DOCUMENTS

| | | | | |
|---|---|---|---|---|
| 3,494,297 A | | 10/1965 | Plasser et al. | |
| 3,608,498 A | * | 9/1971 | Plasser et al. | 104/12 |
| 4,090,451 A | * | 5/1978 | Theurer | 104/12 |
| 4,094,250 A | | 6/1978 | Theurer | |
| 4,094,251 A | | 6/1978 | Theurer | |
| 4,130,063 A | * | 12/1978 | Theurer et al. | 104/12 |
| 4,221,169 A | * | 9/1980 | Theurer | 104/12 |
| 4,563,953 A | * | 1/1986 | Theurer | 104/12 |
| 4,744,303 A | * | 5/1988 | Pasquini | 104/12 |
| 5,133,263 A | | 7/1992 | Theurer | |
| 5,706,734 A | * | 1/1998 | Theurer | 104/12 |

FOREIGN PATENT DOCUMENTS

| | | |
|---|---|---|
| DE | 24 26 841 | 1/1975 |
| JP | 54-4125 | 3/1979 |
| JP | 54-45011 | 4/1979 |

* cited by examiner

*Primary Examiner*—Joseph D. Pape
*Assistant Examiner*—Greg Blankenship
(74) *Attorney, Agent, or Firm*—Collard & Roe, P.C.

(57) ABSTRACT

A ballast tamping tool assembly comprises two tamping tool carriers arranged successively in a longitudinal direction, a pair of tamping picks mounted on each tamping tool carrier, one of the tamping picks of each pair being arranged at a respective end of the assembly in the longitudinal direction for immersion in a respective one of the cribs, another one of the tamping picks of each pair being one of twin tamping picks, the twin tamping picks being arranged for immersion in cribs adjacent the respective cribs for tamping ballast underneath two adjacent ties, and a third tamping tool carrier arranged between the two successively arranged tamping tool carriers, further twin tamping picks mounted on the third tamping tool carrier, the further twin tamping picks being arranged for immersion in a center crib. Each tamping pick is pivotal about a horizontal axis extending transversely to the track, the horizontal axes extending parallel to each other and the longitudinal direction extending perpendicularly to the horizontal axes. Reciprocating drives pivot the tamping picks, and drives for vibrating the tamping picks connect a respective one of the reciprocating drives to a drive for vibrating the tamping picks. The tamping tool carriers are vertically adjustable independently of each other.

4 Claims, 2 Drawing Sheets

ASSEMBLY FOR TAMPING BALLAST

BACKGROUND OF THE INVENTION

Field of the Invention

The present invention relates to an assembly for tamping ballast underneath successive ties of a track, adjacent ones of the ties defining cribs therebetween, in which the ballast tamping assembly comprises two tamping tool carriers arranged successively in a longitudinal direction, a pair of tamping picks mounted on each tamping tool carrier, one of the tamping picks of each pair being arranged at a respective end of the assembly in the longitudinal direction for immersion in a respective one of the cribs, another one of the tamping picks of each pair being one of twin tamping picks, the twin tamping picks being arranged for immersion in cribs adjacent the respective cribs for tamping ballast underneath two adjacent ties, and each tamping pick being pivotal about a horizontal axis extending transversely to the track, the horizontal axes extending parallel to each other and the longitudinal direction extending perpendicularly to the horizontal axes. Reciprocating drives are provided for pivoting the tamping picks, and drives are provided for vibrating the tamping picks, a respective one of the reciprocating drives connecting each tamping pick to a respective one of the vibrating drives. Furthermore, drives are provided for vertically adjusting the tamping tool carriers independently of each other.

Such a ballast tamping assembly has been disclosed in U.S. Pat. No. 5,133,263. The two tamping tool carriers are mounted on a carrier frame of a machine movable on a track and may be vertically adjusted together or separately for immersion of the tamping picks in the ballast. When the tamping tool carriers are vertically adjusted together, a track section comprising three successively arranged ties may be tamped at one time, the tamping picks at the ends of the assembly and one of the tamping picks of the twin tamping picks mounted on the same tamping tool carrier tamping the two outer ones of the three ties while the other tamping picks of the twin tamping picks tamps the center tie. In addition, it is possible to use the machine for tamping a single tie by operating only one of the tamping tool carriers, for example if the ties are irregularly spaced or if some obstacle is encountered.

DE-OS 24 26 841 also discloses a ballast tamping assembly with two tamping tool carriers, each having three tamping picks to tamp either three ties simultaneously or only one tie at a time.

JP 54-45011 describes an arrangement of three ballast tamping tool carriers arranged successively in a longitudinal direction and whose spacing in this direction may be adjusted. Each tamping tool carrier is independently vertically adjustable and has tamping picks for tamping single ties so that it is possible to tamp one, two or three ties at the same time.

The mobile track tamping machine disclosed in U.S. Pat. No. 4,094,250 has two independently vertically adjustable tamping tool carriers spaced from each other in the longitudinal direction. Two twin tamping picks are mounted on each tamping tool carrier and they are so spaced from each other in the longitudinal direction that they may be immersed in adjacent cribs, the tamping picks of each one of the twin tamping picks being spread apart from each other for tamping ballast underneath adjacent ties. In this way, when the tamping picks of both tamping tool carriers are simultaneously operated, the ballast underneath three adjacent ties may be fully tamped as well as half of the ballast underneath the two ties adjacent the group of three ties.

U.S. Pat. No. 3,494,297 discloses tamping of four adjacent track ties without describing the ballast tamping assembly in detail.

SUMMARY OF THE INVENTION

It is the primary object of this invention to provide a ballast tamping assembly of this general type which has an enhanced operating capacity and affords additional operational possibilities.

This object is accomplished with an assembly for tamping ballast underneath successive ties of a track, adjacent ones of the ties defining cribs therebetween, in which the ballast tamping assembly comprises two tamping tool carriers arranged successively in a longitudinal direction, a pair of tamping picks mounted on each tamping tool carrier, one of the tamping picks of each pair being arranged at a respective end of the assembly in the longitudinal direction for immersion in a respective one of the cribs, and another one of the tamping picks of each pair being one of twin tamping picks, the twin stamping picks being arranged for immersion in cribs adjacent the respective cribs for tamping ballast underneath two adjacent ties. According to the invention, a third tamping tool carrier is arranged between the two successively arranged tamping tool carriers, further twin tamping picks being mounted on the third tamping tool carrier, the further twin tamping picks being arranged for immersion in a center crib. Each tamping pick is pivotal about a horizontal axis extending transversely to the track, the horizontal axes extending parallel to each other and the longitudinal direction extending perpendicularly to the horizontal axes, reciprocating drives pivot the tamping picks, and a respective one of the reciprocating drives connects each tamping pick to a drive for vibrating the tamping picks. Drives are provided for vertically adjusting the tamping tool carriers independently of each other.

Such a ballast tamping assembly has a substantially enhanced efficiency and enables the tamping capacity of the machine to be increased since the simultaneous operation of the tamping picks of all three tamping tool carriers fully tamps four ties at once. Compared to conventional machines, this provides an increase of the tamping capacity by one third. At the same time, tamping four ties at the same time effects the uniform quality of the ballast tamping favorably since the simultaneous tamping of four ties better assures such a tamping quality. In addition to the improved economy of this machine, a greater variety of its use can be obtained with respect to the number of ties that may be tamped at the same time. The machine can be used for simultaneously tamping one, two or four ties, being adjustable to select the mode of use according to the prevailing track conditions, for example the spacing between the ties and/or the presence of obstacles. If desired, only every other tie may be tamped or only the two ties at the ends of a group of four adjacent ties.

BRIEF DESCRIPTION OF THE DRAWING

The above and other objects, advantages and features of the invention will become more apparent from the following detailed description of a now preferred embodiment thereof, taken in conjunction with the accompanying drawing wherein.

DETAILED DESCRIPTION OF THE PREFERRED EMBODIMENT

Figure 1:
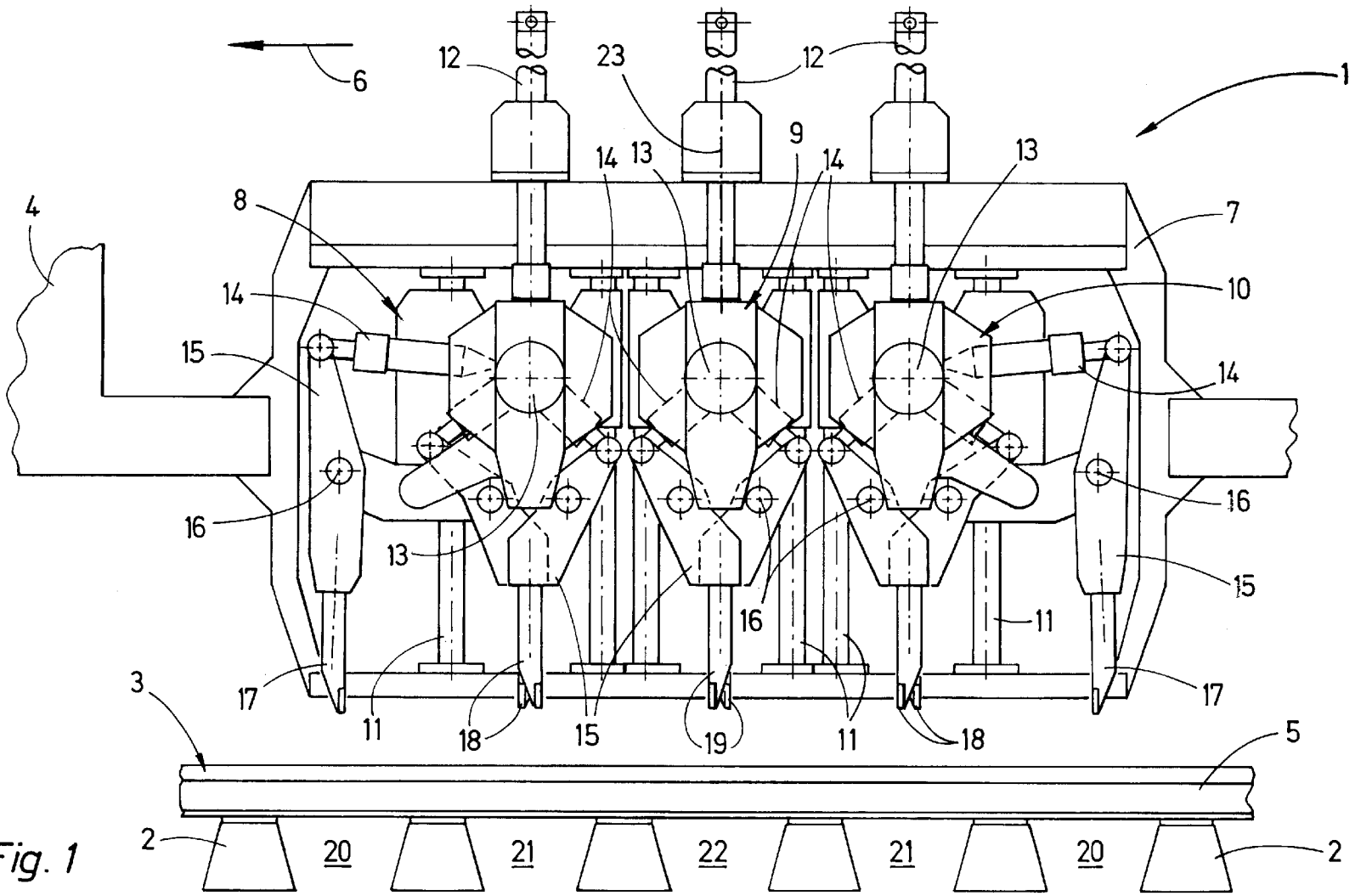
FIG. 1 shows a side elevational view of an assembly for tamping ballast according to the present invention.

FIG. 1 shows assembly 1 for tamping ballast underneath successive ties 2 of track 3, adjacent ones of the ties defining cribs 20, 21, 22 therebetween. The ballast tamping assembly is mounted on partially illustrated carrier frame 4 of a mobile track tamping machine (not shown), which runs on rails 5 of track 3 in a longitudinal operating direction indicated by arrow 6. A respective ballast tamping assembly 1 is associated with each rail 5, only one assembly being shown for the sake of simplicity.

The ballast tamping assembly comprises assembly frame 7 extending in the longitudinal direction above rail 5 on which there are mounted three tamping tool carriers arranged successively in the longitudinal direction. Two vertical guide columns 11 support each tamping tool carrier vertically adjustably on assembly frame 7, the two vertical guide columns being spaced from each other in the longitudinal direction. Drives 12 vertically adjust tamping tool carriers 8, 9, 10 independently of each other.

A pair of tamping picks 17, 18 is mounted on each tamping tool carrier 8, 10 at respective ends of ballast tamping assembly 1. One of the tamping picks 17 of each pair is arranged at a respective end of assembly frame 7 in the longitudinal direction for immersion in a respective one of the cribs 20, another one of the tamping picks 18 of each pair being one of twin tamping picks 18, 18, the twin tamping picks being arranged for immersion in cribs 21 adjacent respective cribs 20 for tamping ballast underneath two adjacent ties 2.

Third tamping tool carrier 9 is arranged between the two successively arranged tamping tool carriers 8, 10, and further twin tamping picks 19, 19 are mounted on the third tamping tool carrier. The further twin tamping picks are arranged for immersion in center crib 22. Each tamping pick 17, 18, 19 is pivotal about horizontal axis 16 extending transversely to track 3, the horizontal axes extending parallel to each other and the longitudinal direction extending perpendicularly to the horizontal axes.

Reciprocating drives 14 are linked to the upper ends of tamping tools 15 whose lower ends carry the tamping picks for pivoting the tamping picks, and drives 13, which are constituted by crank shafts, vibrate the tamping picks, a respective one of the reciprocating drives 14 connecting each tamping pick 17, 18, 19 to a respective one of the vibrating drives 13.

The horizontal axes 16 of the twin tamping picks 18 and 19 are spaced from each other in the longitudinal direction.

The tamping tool carriers and tamping picks are arranged mirror-symmetrically with respect to a plane of symmetry 23 extending perpendicularly to the longitudinal direction.

Figure 2:
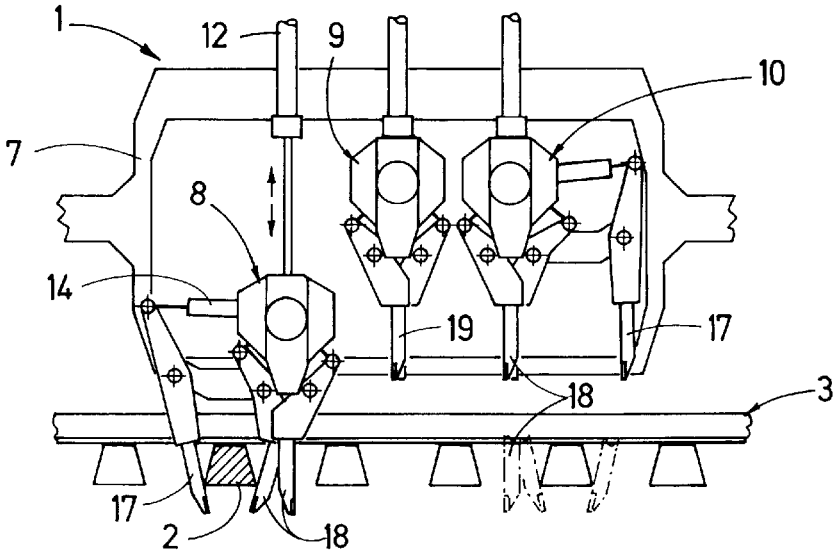
FIGS. 2 to 4 are greatly simplified side views of the ballast tamping assembly in different modes of operation.

In the mode of operation shown in FIG. 2, only one of the end tamping tool carriers 8 has been vertically adjusted by drive 12 for immersion of tamping picks 17, 18 in the ballast while the two other tamping tool carriers 9, 10 remain inoperative, possibly because an obstacle has been encountered in the cribs. In this mode of operation, only hatched tie 2 is tamped, one tamping pick 18 of the twin tamping picks remaining in the vertical position, i.e. not being pivoted. If the obstacle is encountered only in center crib 22, the other end tamping tool carrier 10 may be operated in the same manner as tamping tool carrier 8, as indicated in phantom lines in FIG. 2.

Figure 3:
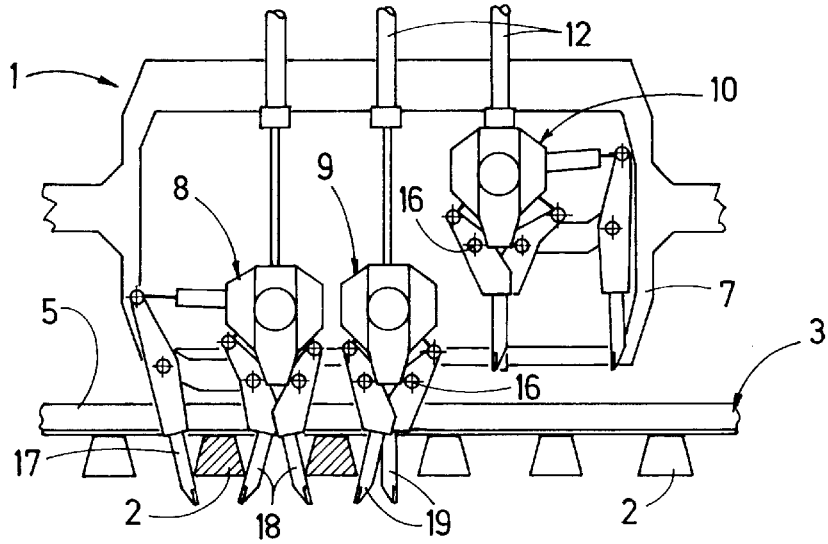

In the operating mode shown in FIG. 3, tamping tool carriers 8 and 9 are operated, in which case tamping pick 17 and both twin tamping picks 18 are pivoted while one tamping pick 19 remains in the vertical position, i.e. is not pivoted. Tamping tool carrier 10 remains inoperative to tamp only two hatched ties 2.

Figure 4:
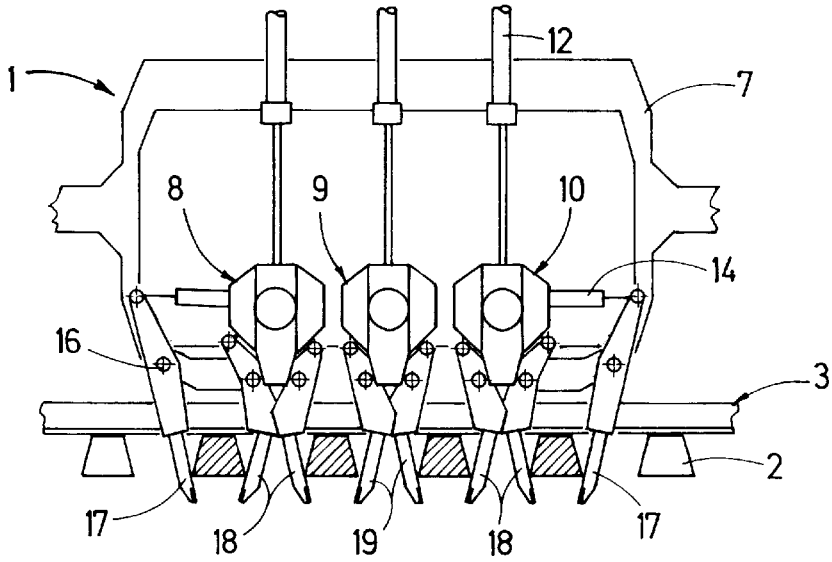

Finally, in the mode of operation shown in FIG. 4, all three tamping tool carriers 8, 9 and 10 are vertically adjusted to immerse all tamping picks 17, 18, 19 in the ballast, all tamping picks being pivoted to tamp four adjacent hatched ties 2.

What is claimed is:

1. An assembly for tamping ballast underneath successive ties of a track, adjacent ones of the ties defining cribs therebetween and the ballast tamping assembly comprising (a) two tamping tool carriers arranged successively in a longitudinal direction, (b) a pair of tamping picks mounted on each tamping tool carrier, (1) one of the tamping picks of each pair being arranged at a respective end of the assembly in the longitudinal direction for immersion in a respective one of the cribs, (2) another one of the tamping picks of each pair being one of twin tamping picks, the twin tamping picks being arranged for immersion in cribs adjacent the respective cribs for tamping ballast underneath two adjacent ties, and (c) a third tamping tool carrier arranged between the two successively arranged tamping tool carriers, (d) further twin tamping picks mounted on the third tamping tool carrier, the further twin tamping picks being arranged for immersion in a center crib, (1) each tamping pick being pivotal about a horizontal axis extending transversely to the track, the horizontal axes extending parallel to each other and the longitudinal direction extending perpendicularly to the horizontal axes, (e) reciprocating drives for pivoting the tamping picks, (f) drives for vibrating the tamping picks, a respective one of the reciprocating drives connecting each tamping pick to a respective one of the vibrating drives, and (g) drives for vertically adjusting the tamping tool carriers independently of each other.

2. The ballast tamping assembly of claim 1, wherein the horizontal axes of the twin tamping picks are spaced from each other in the longitudinal direction.

3. The ballast tamping assembly of claim 1, further comprising two vertical guide columns supporting each tamping tool carrier, the two vertical guide columns being spaced from each other in the longitudinal direction.

4. The ballast tamping assembly of claim 1, wherein the tamping tool carriers and tamping picks are arranged mirror-symmetrically with respect to a plane of symmetry extending perpendicularly to the longitudinal direction.

* * * * *